US005425467A

United States Patent [19]

Feer et al.

[11] Patent Number: 5,425,467

[45] Date of Patent: Jun. 20, 1995

[54] BOWL LID HAVING INTEGRAL LEVER MECHANISM

[75] Inventors: David L. Feer, Dorchester, Mass.; William A. Pesa, Wooster, Ohio

[73] Assignee: Rubbermaid Incorporated, Wooster, Ohio

[21] Appl. No.: 174,505

[22] Filed: Dec. 28, 1993

[51] Int. Cl.[6] ..... B65D 43/04

[52] U.S. Cl. ..... 220/281; 220/352; 220/356

[58] Field of Search ..... 220/356, 306, 281, 352, 220/355, 285

[56] References Cited

U.S. PATENT DOCUMENTS

| | | | |
|---|---|---|---|
| D. 228,867 | 10/1973 | Mallonn | D7/131 |
| D. 229,737 | 1/1974 | Taylor | D7/131 |
| D. 230,342 | 2/1974 | Mallonn | D7/131 |
| D. 230,343 | 2/1974 | Mallonn | D7/131 |
| D. 230,344 | 2/1974 | Taylor | D7/131 |
| D. 230,556 | 3/1974 | Mallonn | D7/131 |
| D. 329,572 | 9/1992 | Krupa | D7/542 |
| 2,788,893 | 4/1957 | Harkness et al. | 220/356 X |
| 3,128,902 | 4/1964 | Barnum | 220/281 |
| 3,378,163 | 4/1968 | Griffith | 220/355 X |
| 3,422,984 | 1/1969 | Foster | 220/269 |
| 3,526,334 | 9/1970 | Ashton et al. | 220/23.83 |
| 3,688,942 | 9/1972 | Mitchell et al. | 220/306 |
| 3,719,304 | 3/1973 | Douglas | 220/42 |
| 3,753,512 | 8/1973 | Curry | 220/43 |
| 3,773,207 | 11/1973 | Dokoupil et al. | 220/306 X |
| 3,809,284 | 5/1974 | Churan | 220/60 |
| 3,979,015 | 9/1976 | Arfert | 220/307 |
| 3,982,651 | 9/1976 | Braun et al. | 220/4 |
| 4,111,330 | 9/1978 | Jordan | 220/306 |
| 4,194,645 | 3/1980 | Zabner et al. | 220/306 |
| 4,209,107 | 6/1980 | Crisci | 220/306 |
| 4,341,324 | 7/1982 | Ramirez | 220/306 |
| 4,412,630 | 11/1983 | Daenen | 220/353 |
| 4,471,880 | 9/1984 | Taylor | 220/306 |
| 4,493,432 | 1/1985 | Smith | 220/270 |
| 4,561,562 | 12/1985 | Trombly | 220/306 |
| 4,664,288 | 5/1987 | Pereira et al. | 220/209 |
| 4,709,832 | 12/1987 | Mantyla | 220/306 |
| 4,793,510 | 12/1988 | Arfert et al. | 220/306 |
| 4,795,056 | 1/1989 | Meyers | 220/306 |
| 4,809,868 | 3/1989 | Pomroy | 220/260 |
| 5,143,219 | 9/1992 | Yates, Jr. | 220/508 |

OTHER PUBLICATIONS

Pp. 6, 7 and 22, Food storage container lids; Tupperware Home Parties, Inc., Orlando, Fla. Publication date Fall/Holiday 1992.

Catalog page, Food storage container lids; Anchor Hocking Plastics, P.O. Box 64610, St. Paul, Minn 55164. Publication date 1992.

P. 13, Food storage container lids; Tucker Housewares, 25 Tucker Drive, Leominster, Mass. 01453. Publication date 1993.

Pp. 20 and 23, Food storage container lids; Dupol-Rubbermaid GmbH, An der Trift 63, D-6072 Dreieich, West Germany, Publication date 1989.

Sell Sheet, Food storage container lids; Rubbermaid Commerical Products Inc., 3124 Valley Avenue, Winchester, Va 22601. Publication date 1989.

Pp. 12 and 13, Food storage container lids; Rubbermaid Incorporated, 1147 Akron Road, Wooster, Ohio 44691. Publication date 1986.

Catalog page, Food storage container lids; Rubbermaid Incorporated, 1147 Akron Road, Wooster, Ohio 44691. Publication date 1992.

Catalog page, Food storage container lids; Rubbermaid Incorporated, 1147 Akron Road, Wooster, Ohio 44691. Publication date 1992.

*Primary Examiner*—Allan N. Shoap

*Assistant Examiner*—Vanessa Caretto

*Attorney, Agent, or Firm*—Richard B. O'Planick; Lisa B. Riedesel

[57] ABSTRACT

A container lid (10) is disclosed for enclosing a container (12). The lid has a top wall (14), and a peripheral rim flange (18) dimensioned to flex outward and receive the upper rim of the container therebetween. The rim flange (18) terminates at a downturned skirt (20). A lever arm skirt portion (32) is provided to extend vertically downward from the lid rim flange, and tapers inward from a top end (38) to a bottom end (40). The lever arm (32) is pivotal outward, whereby applying a force moment to the rim flange (18) which serves to break the seal between the rim flange and the outside rim surface (34) of the container (12), and allow the lid to be easily removed therefrom.

16 Claims, 5 Drawing Sheets

BOWL LID HAVING INTEGRAL LEVER MECHANISM

BACKGROUND OF THE INVENTION

1. Field of the Invention

The present invention relates to flexible plastic lids for plastic containers and more specifically to such lids which apply a seal to the external upper rim surface of associated bowl containers.

2. The Prior Art

Plastic storage containers and lids are well accepted commercial items. Such products have widespread use, particularly in the storage of foodstuffs. Typical containers are cylindrical bowls which are offered in various volumetric sizes. The lid which is affixed to each bowl, and which seals the container, is generally comprised of a top wall which merges into a downturned rim flange which, in turn, merges into a downturned skirt. The lid inner diameter is slightly smaller than the outside diameter of the container upper rim such that, when the lid is pressed downward over the container rim, the container rim flange first flexes outwardly over the container rim and then is resiliently drawn inward, whereby clasping the container outer surface in a sealing grip.

U.S. Pat. No. 4,471,880 teaches such a configuration. The lid is applied by a center applied pressure, flexes outward at the rim flange, and is drawn inward against the container outer surface to effectuate a hermetic seal. This container and lid has met with considerable commercial success and is effective in achieving satisfactory sealing of the container contents from ambient air.

However, certain shortcomings of the patented container, and in particular the lid, prevent it from representing an ideal solution to the consumer's needs. First, because of the effectiveness of the seal, the lid is difficult to remove from the container. Secondly, a horizontal terminal tab on the downturned skirt of the lid, which is intended to provide a grip for the application of an upward force to break the seal and remove the lid, is generally too small to afford the user a convenient grasp.

The first aforementioned deficiency is because the application of a vertical force on a horizontal flange is an ineffective way to break a seal which is maintained by forces operating in a horizontal direction. That is, the application of a vertical force on a horizontal flange primarily acts to bend the flange upward, and transfers little force in the horizontal direction by which to break the seal between the inner surface of the lid skirt and the outer surface of the container. In order to remove the lid of the prior art, one must essentially slide a portion of the lid upward by the application of a vertical force to the horizontal flange. However, the horizontally directed sealing forces between the lid and the container create substantial frictional resistance countering such vertical movement. Consequently, a substantial amount of force must be applied to effectuate separation of the lid by sliding it upward.

In fact, the amount of force required can exceed the capability of children and adults, and particularly elderly adults. Other containers are available in the prior art and commercial markets which attempt to make the lid easier to remove by making the horizontal flange larger. Making the flanges or tabs larger, however, while making them easier to grasp, does not make the lid easier to remove, for the problem caused by the inappropriate directional application of force to the tabs and flanges remains.

SUMMARY OF THE INVENTION

The improved lid of the present invention overcomes the disadvantages in the prior art by providing a lid having integral means for mechanically assisting the removal of the lid from a container. The lid has a top wall which merges with a downturned periphery which, in turn, merges into a downturned rim flange. The rim flange fits over the container rim and is thereafter drawn inward by the resiliency of the lid top wall. The rim flange terminates in an outwardly flared skirt which is adapted to provide a lever portion depending from the rim flange and extending below the lower edge of the flared skirt. The lever portion tapers in width from a top end to a bottom end, and extends downward at least one-third the height of the base container. The top end of the lever portion is connected to the rim flange and has a width corresponding to between twenty and forty percent of the lid circumference.

The lever portion is substantially vertically oriented and is foraged of resilient plastic material. As it is flexed outward, it exerts a horizontal force moment on the rim flange, breaking the seal of the lid and enabling its easy removal from the base. The outward flare of the lever portion allows sufficient room for the user's fingers, and the arcuate shape of the lever portion and tapered width dimension allow a positive manual grasp to be established.

Accordingly, it is an objective of the present invention to provide a resilient container lid which is easily removed and attached to a base container.

A further objective is to provide a container lid having an ergonomic handle for convenient grasp by a user.

A still further objective is to provide a container lid having a mechanically assisted opening mechanism.

Yet a further objective is to provide a container lid of sturdy construction which is stackable for convenient transportation and display at retail.

A further objective is to provide a container lid having means for removal which is actuatable by senior citizens and children.

Another objective is to provide a container lid which is economically produced and conveniently utilized.

These and other objectives, which will be apparent to those skilled in the art, are achieved by a preferred embodiment which is described in detail below and which is illustrated in the accompanying drawings.

DESCRIPTION OF THE PREFERRED EMBODIMENT

Figure 1:
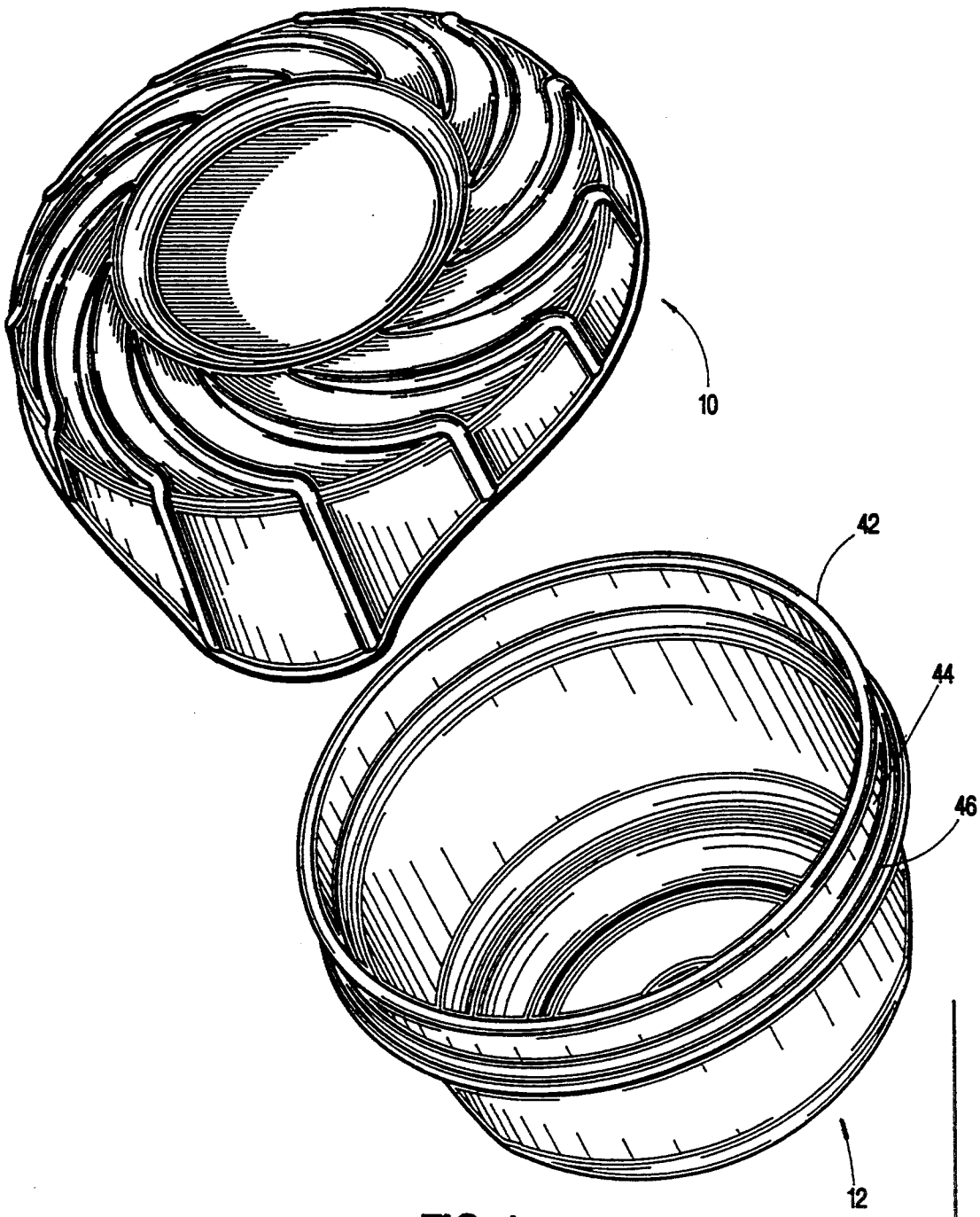
FIG. 1 is an exploded perspective view of the subject lid and the bowl base to which it attaches.

Referring to FIG. 1, the subject lid 10 and base container 12 are shown. The lid is molded of semi-rigid plastic such as linear low density polyethylene, or other suitable plastic having resiliency suitable for the intended operation. The lid and base can be formed in various sizes and capacities if so desired. Details on a lid and base container of the preferred type is disclosed in U.S. Pat. No. 4,471,880, which is incorporated herein by reference. The patent also gives specifications on the manner in which the lid fits over and seals against the outer rim surface of the base container.

Figure 3:
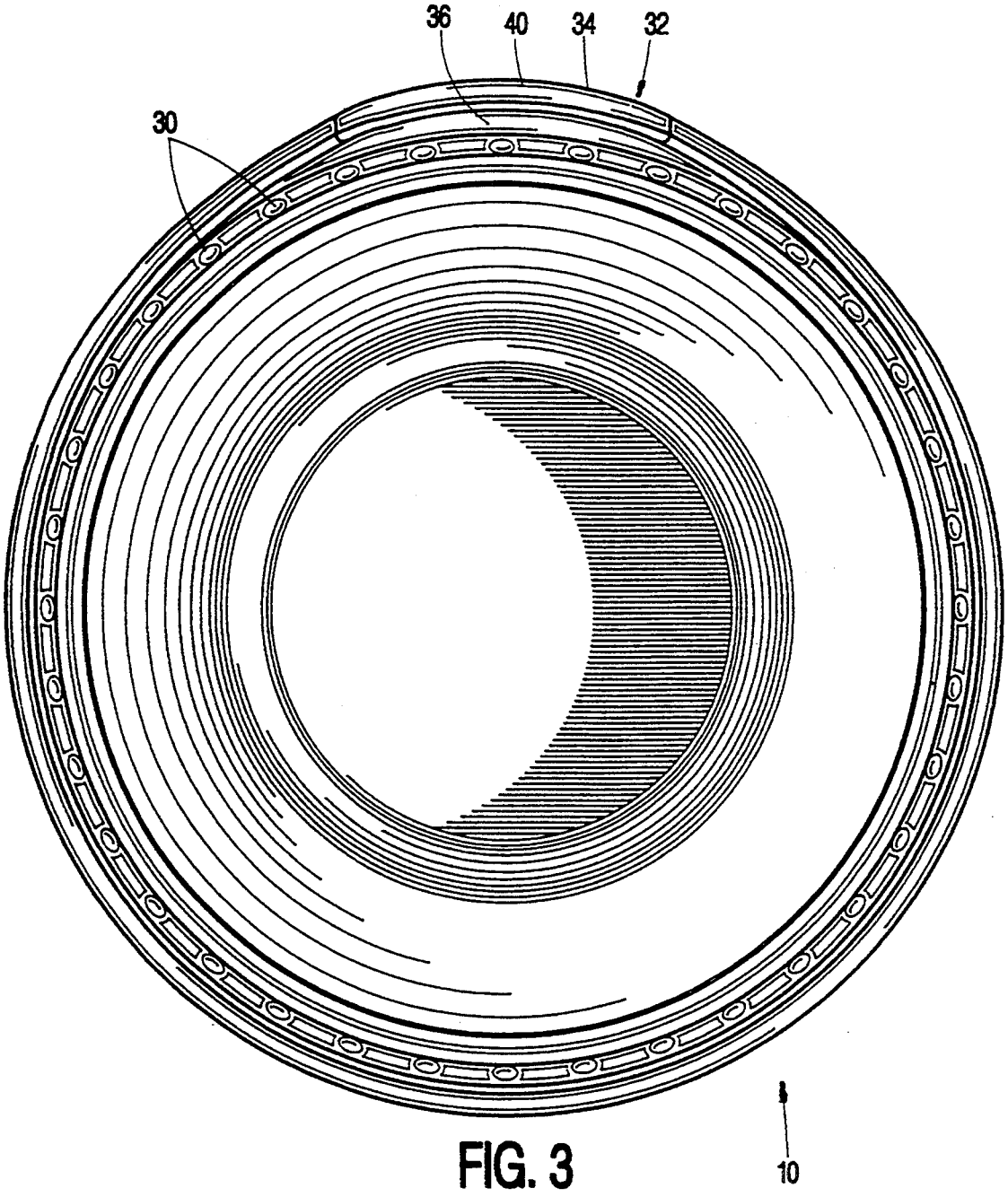
FIG. 3 is a bottom plan view of the bowl lid.
Figure 4:
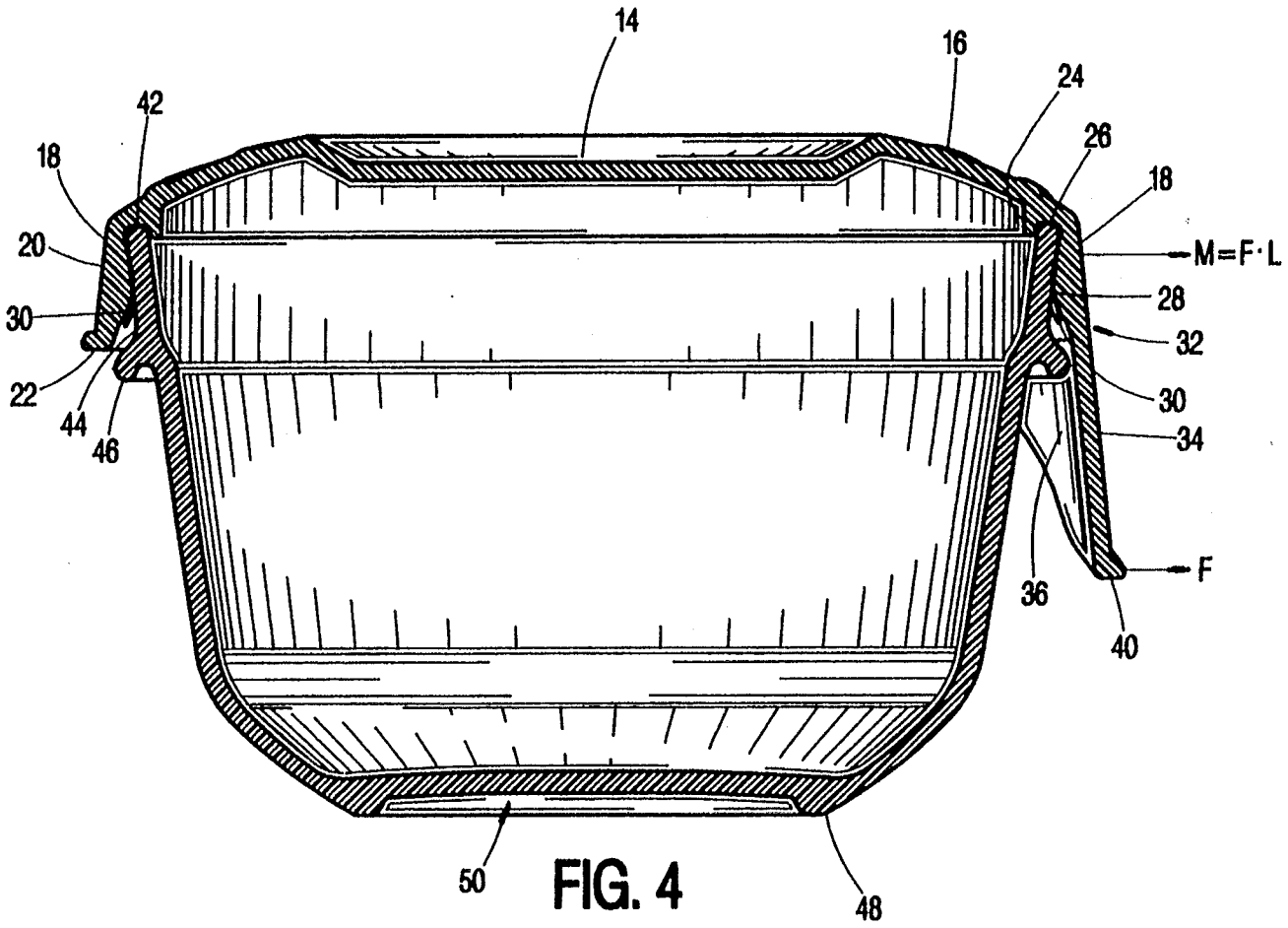
FIG. 4 is a transverse section view of the bowl lid and base, taken along the line 4—4 of FIG. 2.

With reference to FIGS. 1, 3, and 4, the subject lid 10 and base 12 are shown as having a cylindrical geometric configuration. The lid 10 comprises a medial top surface 14 which merges in a radial direction with an annular peripheral surface 16, which merges into a downturned outer rim flange 18. The outer flange 18 merges into a downturned skirt which terminates at a lower end 22. In general, the lower end 22 of the skirt 20 is horizontal and equidistant from the top of the lid around its circumference.

The lid further comprises an inner circumferentially extending flange 24 which defines, with the inner surface of the rim flange 18, an inverted U-shaped channel 26. Channel 26 circumferentiates the underside of the lid. The rim flange 18 provides an inward directed shoulder 28 which circumferentiates the lid as shown.

Spaced apart bead protrusions 30 extend around the lid, projecting inwardly from the rim flange 18 and positioned below the shoulder 28. The purpose of the rim flanges 18, shoulder 28, and beads 30 will readily be appreciated from U.S. Pat. No. 4,471,880.

Figure 2:
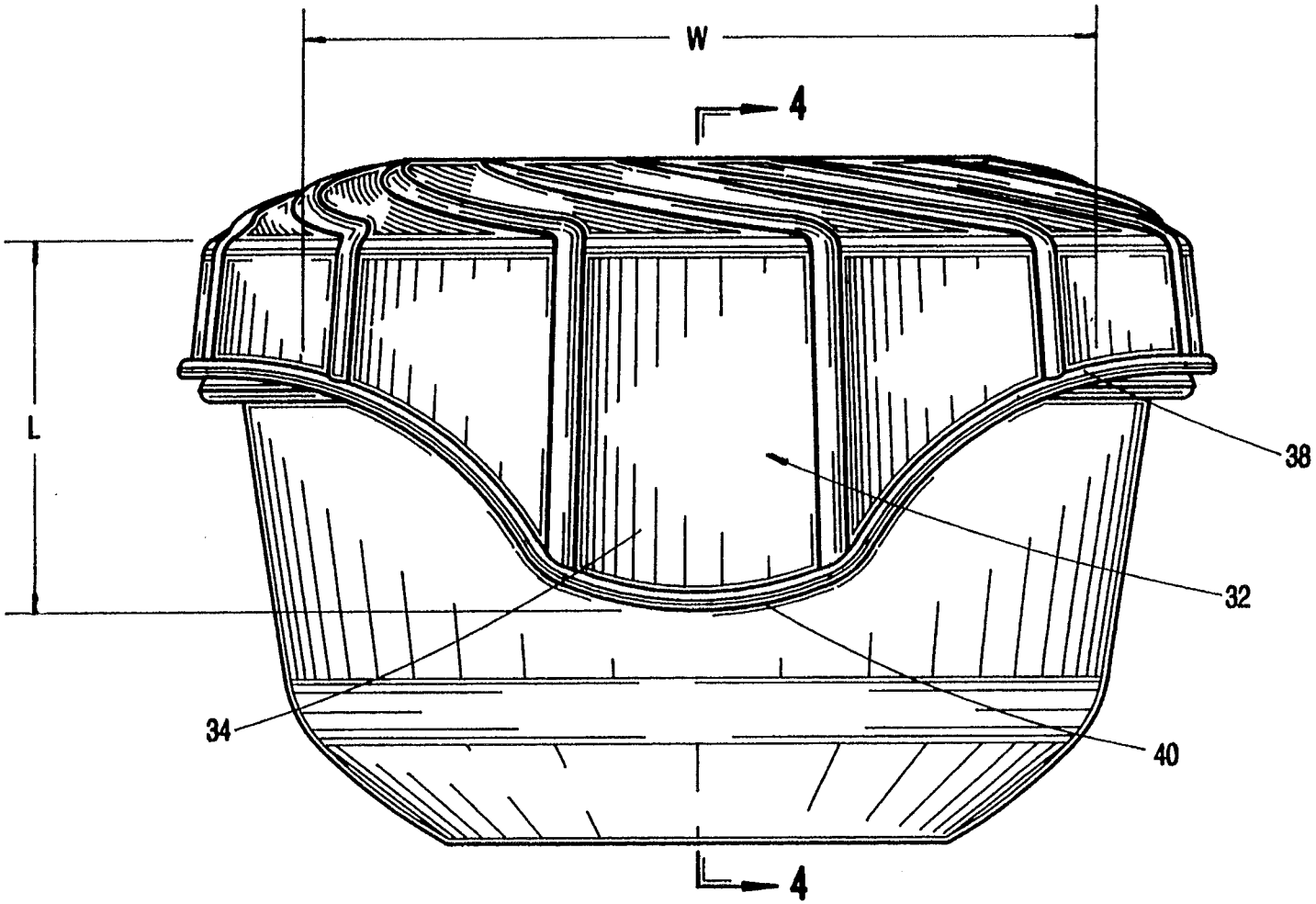
FIG. 2 is a side elevation view of the bowl lid and base in the assembled condition.

A skirt lever portion, in the shape of a flap 32, is shown to extend downward from the rim flange 18. The skirt flap 32 is inwardly concave, providing a radiussed inner surface 36 and an arcuate outer surface 34. The flap 32 has an upper end 38 which is integrally formed to the rim flange 18, and a lower end 40 which projects downward and below the nominal lower edge 22 of the skirt 20. The flap 32 tapers in width from the top end 38 to the bottom end 40 as best shown in FIG. 2. The width "W" of the flap 32 at the juncture where it connects with the rim flange 18 is optionally twenty five percent of the circumference of the lid 10, but may be varied within a range of twenty to forty percent of the lid circumference. In addition, the length "L" of the flap 32 relative to the height of the container 12 can vary within limits. For smaller containers, of which FIG. 2 illustrates one, the flap 32 extends downward to a midpoint of the container height. However, for larger capacity containers, the flap can extend downward to only one-third of the container height and still function within the intended purposes set forth herein.

The container 12 to which lid 10 attaches is shown to have an upper rim 42, an outer surface 44 portion 44 proximate the upper rim 42, and an exterior horizontal strengthening flange 46 which is positioned below the portion 44. The container further has a bottom 48 and a central bottom portion 50 adapted to register with the central lid portion 14 for the purpose of stacking one lid and container combination on another. The container 12 is frustro-conical in overall shape and tapers inwardly from top to bottom.

FIG. 1 shows the lid exploded from the base container, and FIGS. 2–4 show the lid in its attached position. From FIG. 4 and the patent referenced above, it will be appreciated that the inner diameter of the rim flange 18 is slightly less than the outer diameter of the container rim 42. As the lid is pressed downward over the container rim, the rim flange 18 flexes outward to receive the container rim therebetween. Then, with the lid in its final position, the beam strength of the lid center pulls the rim flange 18 inward and establishes a tight seal.

The seal is effective and is maintained by the horizontally directed forces, exerted by the lid. throughout the rim flange 18 on the outer rim surface 44 of the container. The forces pressing the lid rim flange 18 against the rim surface 44 create a strong fictional resistance to the lid moving in an upward direction while the seal is in effect. So effective is this frictional resistance that it is difficult to move the lid upward with the seal intact.

The operation of the lever pop, ion flap 32 to overcome the frictional force created by the seal will be readily understood in light of the above. The flap 32 is oriented in a substantially vertical orientation, integrally joined at its upper end to the rim flange 18. The flap 32 is outwardly flared to position the lower end 40 away from the container a sufficient distance to allow admittance of a user's fingers.

As the lower end 40 of the flap 32 is pulled away from the container by a three "F" (FIG. 4), a horizontal three moment is applied to the rim flange 18 in a direction opposite to the sealing force imposed on the rim flange 18 by the lid. The force moment "M" is equal to the applied force "F" times the length "L" of the lever arm 32. As the lid beam forces are overcome, the seal between the rim flange 18 and the container is broken, whereby enabling an easy removal of the lid from the container. The imposition of a horizontal counterforce to the sealing force is achieved optimally, therefore, by the lever arm (flap 32) pivoting outward.

The length of the flap 32 is selected to generate an appropriate level of force to the rim flange 18 by which to facilitate the breaking of the seal. For larger containers, such as a 1.5 liter bowl, a flap extending down one third of the bowl will suffice; for smaller bowls, such as a 0.5 liter bowl, the flap optimally will extend down to approximately the midpoint of the bowl.

The flap 32 is formed to taper in width from a top end to a bottom end. The relatively narrow lower flap end 40, and its concave configuration, allows convenient hand grasp by all categories of users. The top end 38 is optimally twenty-five percent of the lid circumference so that, when the flap 32 is actuated, a substantial portion of the circular seal between the lid and the container base is broken simultaneously, and the lid "pops" off the container. However, the width "W" can vary between twenty to forty percent of the lid circumference and still permit the lever arm to function in accordance with the invention.

The flap 32, as mentioned above, is arcuate in geometry. This form increases the flap's rigidity and resistance to bending in the outward direction, whereby enabling efficient transfer of the seal breaking forces from the lower end to the upper end. The outward bow of the flap resists bending and allows the flap to remain a fixed and rigid lever as pulling force is applied. In addition, as mentioned previously, the arcuate bow of the flap 32 is comfortable to the user and facilitates a strong and easy grasp.

From the foregoing, it will be appreciated that the subject invention marks a significant improvement over container lids which provide a horizontal release tab or flange. With a horizontal tab, an upwardly applied force will have a negligible horizontal force component with which to break the horizontally directed forces exerted by the lid against the container. Even increasing the upward three is not effective since the force is still being applied in a direction which will not break the seal.

Thus, a lid having a horizontal tab must be moved vertically until its circumferential geometry is distorted to the point where the seal is broken. A significantly greater force is required to accomplish a breaking of the seal by a vertical distortion in conventional lids than breaking of a seal by the application of a lever force as taught by subject invention.

It will also be apparent that the configuration of the lid is such that multiple lids may be stacked upon one another, whereby conserving space during shipment and in retail environments.

While the above describes the preferred embodiment of the subject invention, the invention is not to be so restricted. Other embodiments which will be apparent to those skilled in the arts and which utilize the teachings herein set forth are intended to be within the scope and spirit of the subject invention.

Figure 5:
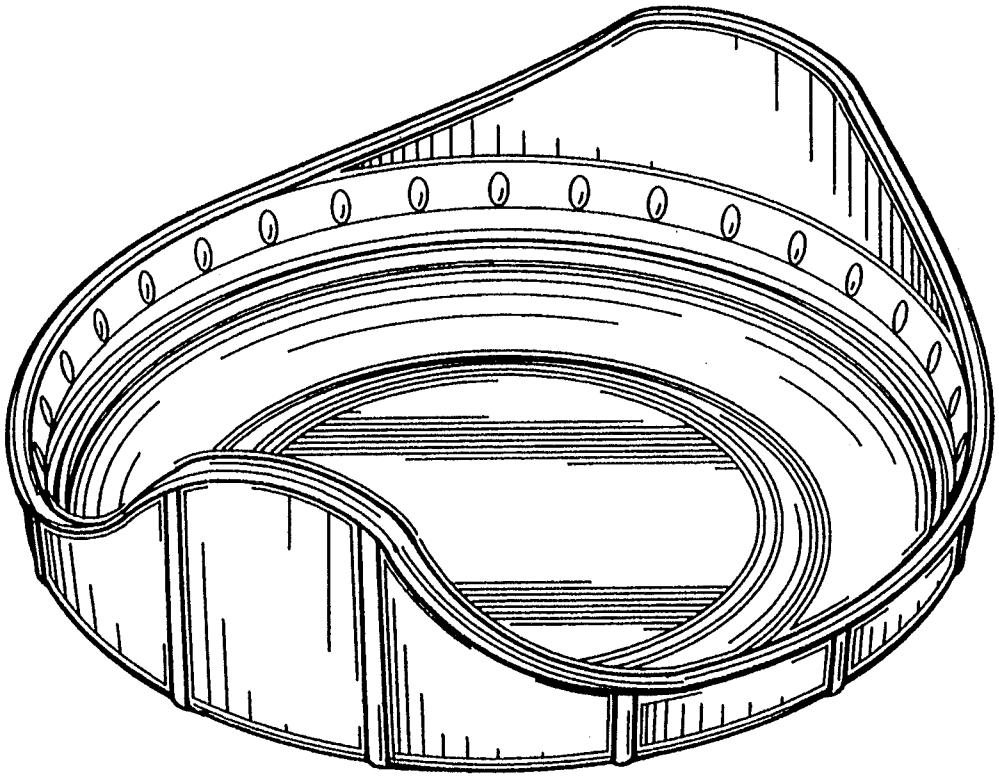
FIG. 5 is a bottom perspective view of an alternative embodiment of the subject invention.

For example, more than one lever portion may be employed as in the alternative embodiment shown in FIG. 5.

I claim:

1. A storage container comprising:

a container base having an upper rim and a substantially vertical outer peripheral surface located proximate to the upper rim;

a lid having a top wall and a downturned periphery terminating in an outer rim flange for fitting over the container base rim, an inner diameter of the rim flange being slightly less than an outer diameter of the container rim and the lid fitting over the container base upper rim and establishing a continuous sealing engagement between the lid rim flange and the container base outer surface;

an outwardly flared skirt extending continuously along the lid periphery and depending from the lid rim flange to a lower terminal skirt edge, the flared skirt having an integrally formed cantilever lever portion depending from a segment of the lower terminal skirt edge and extending substantially below the lower terminal skirt edge of the flared skirt, and the lever portion extends in a vertical direction and flexes outward and away from the container base to temporarily flex and non-frangibly deform the terminal skirt edge segment and a lid flange portion located above the terminal skirt edge segment outward, whereby breaking the sealing engagement between the lid rim flange portion and the container base outer surface.

2. A container according to claim 1, wherein the container base having a radiussed external geometry and the lever portion having an inwardly concave vertical sectional configuration.

3. A container according to claim 1, wherein the lever portion extends downward at least one-third of the height of the container base.

4. A container according to claim 3, wherein the container base having an exterior flange positioned below the skirt of the lid when it is in the sealing position, and the lever portion extends outside and below the container base flange.

5. A container according to claim 1, wherein the lever portion having a top end connected to the rim flange, the top end having a width dimension variable within a range defined as between twenty to forty percent of the lid peripheral length.

6. A storage container comprising:

a container base having an upper rim and an outer substantially vertical peripheral surface located proximate to the upper rim;

a resilient lid having a top wall and a peripheral outer rim flange for fitting over the container base rim, an inner diameter of the rim flange being slightly less than an outer diameter of the container rim and the lid fitting over the container base upper rim and establishing a continuous sealing engagement between the lid rim flange and the container base outer peripheral surface;

an outwardly flared skirt extending continuously along the peripheral rim flange and depending from the lid rim flange to a lower terminal skirt edge, the flared skirt having at least one integrally formed lever skirt portion depending from a segment of the skirt terminal edge, the lever skirt portion extending substantially in a vertical orientation and pivoting outward and away from the container base responsive to digital pressure to temporarily flex and non-frangibly deform the skirt terminal edge segment outward and leverage a portion of the lid rim flange located above the skirt terminal edge segment away from the container base outer peripheral surface, whereby breaking the sealing engagement between the lid rim flange portion and the base outer peripheral surface.

7. A container according to claim 6, wherein the container base having a radiussed external geometry and the lever portion having an inwardly concave vertical sectional configuration.

8. A container according to claim 6, wherein the lever portion tapers in width from a top end to a bottom end, the top lever end having a relatively wide dimension joining to the skirt terminal edge and the lever bottom end having a relatively narrow digit sized width.

9. A container according to claim 8, wherein the lever portion top end width dimension is variable within a range defined as between twenty to thirty percent of the lid peripheral length.

10. A container according to claim 9, wherein the lever portion extends downward at least one-third of the height of the container base.

11. A container according to claim 10, wherein the container base having an exterior flange positioned below the outer peripheral surface, the lid lever portion extending outside of and below the container base flange with the lid positioned upon the container base.

12. A storage container comprising:

a container base having an upper rim and a outer substantially vertical peripheral surface located proximate to the upper rim;

a lid having a top wall and a peripheral outer rim flange for fitting over the container base rim, an inner diameter of the rim flange being slightly less than an outer diameter of the container rim and the lid fitting over the container base upper rim and establishing a continuous sealing engagement between the lid rim flange and the container base outer peripheral surface;

a lid skirt of substantially uniform sectional thickness extending along the lid peripheral rim flange and depending from the lid rim flange to a lower terminal skirt edge, the container base having a radiussed external geometry and the flared skirt having a complimentarily radiussed inner surface;

at least one integrally formed lever arm skirt portion joined at a top end to a segment of the skirt terminal edge and having a lower end depending below the skirt terminal edge, the lever arm skirt portion tapering in width from the top end to the lower end; and wherein the lever arm portion of the skirt pivots outward and away from the container base, whereby applying a sufficient force moment in the horizontal direction through the skirt terminal edge segment to the rim flange to temporarily flex and non-frangibly deform the skirt terminal edge segment outward and break the sealing engagement between a portion of the rim flange located above the skirt terminal edge segment and the container base outer peripheral surface.

13. A container according to claim 12, wherein the container base and lid are substantially cylindrical and the lid lever portion top end connects to the skirt terminal edge segment and has a width that is variable within a range defined as between twenty to thirty percent of the lid circumference.

14. A container according to claim 13, wherein the lever portion lower end is of a relatively narrow digit sized width.

15. A container according to claim 14, wherein the container base having an exterior flange positioned below the outer peripheral surface and the lever portion extends outside and below the container base flange with the lid positioned upon the container base.

16. A container according to claim 15, wherein the lever portion extends downward at least one-third of the height of the container base in the sealing position.

* * * * *

UNITED STATES PATENT AND TRADEMARK OFFICE

CERTIFICATE OF CORRECTION

PATENT NO. : 5,425,467

DATED : June 20, 1995

INVENTOR(S) : David L. Feer, William A. Pesa

It is certified that error appears in the above-indentified patent and that said Letters Patent is hereby corrected as shown below:

Column 2, Line 23, delete the word "foraged" and substitute therefor the word --formed--.

Column 3, Line 39, delete the word "optionally" and substitute therefor the word --optimally--.

Column 4, Line 4, change "." to --,-- after "lid".

Column 4, Line 11, delete the word "pop, ion" and substitute therefor the word --portion--.

Column 4, Line 19, delete the words "three" and substitute therefor the words --force--.

Column 4, Line 67, delete the word "three" and substitute therefor the word --force--.

Column 5, Line 45, insert the word --rim-- after "lid".

Signed and Sealed this

Nineteenth Day of September, 1995

*Attest:*

Bruce Lehman

BRUCE LEHMAN

*Attesting Officer*

*Commissioner of Patents and Trademarks*